United States Patent [19]

Cheris et al.

[11] 4,097,628

[45] Jun. 27, 1978

[54] CARPET RUNNER

[75] Inventors: Albert B. Cheris, Glenview; Lonnie E. Frye, Elk Grove Village, both of Ill.

[73] Assignee: Tenex Corporation, Elk Grove Village, Ill.

[21] Appl. No.: 638,703

[22] Filed: Dec. 8, 1975

[51] Int. Cl.[2] ..... B65D 65/28

[52] U.S. Cl. ..... 428/43; 428/167; 428/906

[58] Field of Search ..... 428/43, 156, 131, 151, 428/174, 179, 906, 99, 167, 223; 264/175, 167, 284; 16/1, 8–11, 16; 206/390

[56] References Cited

U.S. PATENT DOCUMENTS

| | | | |
|---|---|---|---|
| 1,900,987 | 3/1933 | Goff | 428/43 |
| 2,508,855 | 5/1950 | Brown | 428/43 |
| 2,704,267 | 3/1955 | Tilden, Jr. | 206/390 X |
| 3,551,544 | 12/1970 | Hlinka | 264/175 |
| 3,762,985 | 10/1973 | Chaitman | 428/43 |
| 3,801,424 | 4/1974 | Robbins, Jr. | 428/167 X |

*Primary Examiner*—Marion E. McCamish

*Attorney, Agent, or Firm*—Wegner, Stellman, McCord, Wiles & Wood

[57] ABSTRACT

An improved carpet runner for self-service sales in discount stores or the like without the need for assistance of a clerk. The runner includes an elongated web of flexible, liquid-impervious plastic material having on one side thereof a plurality of projections for gripping the nap of an underlying carpet. The improved runner includes a plurality of substantially equally spaced, liquid-impervious, transverse lines of weakening extending across the web so that a desired predetermined length of the web may be easily separated from the remainder of the web along a desired one of the lines of weakening without the use of a tool.

2 Claims, 4 Drawing Figures

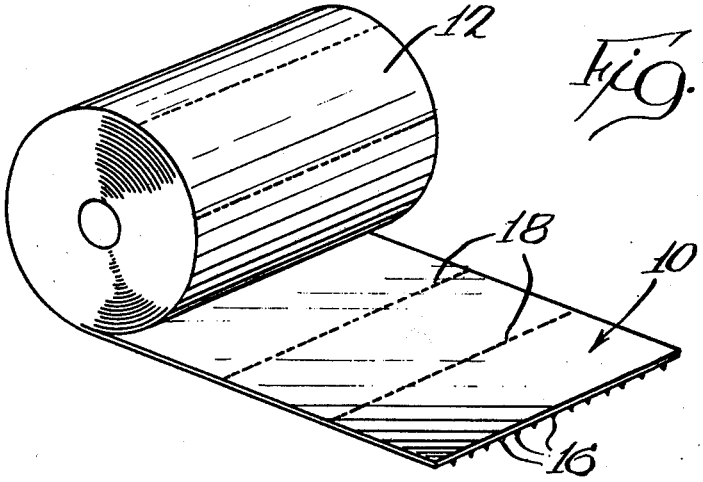
Fig. 1.
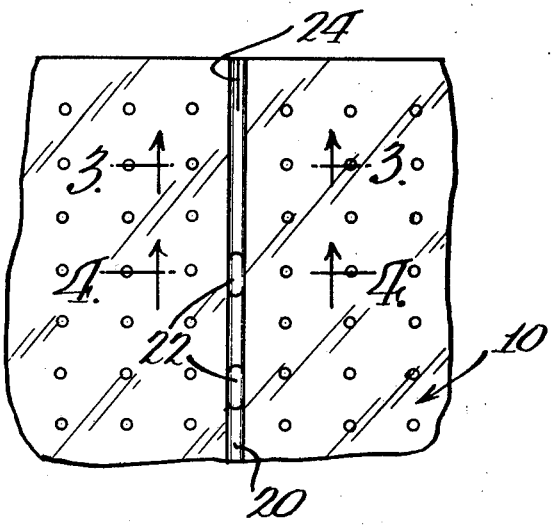
Fig. 2.
Fig. 3.
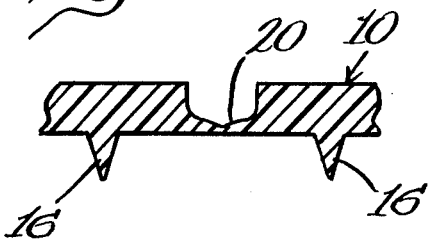
Fig. 4.
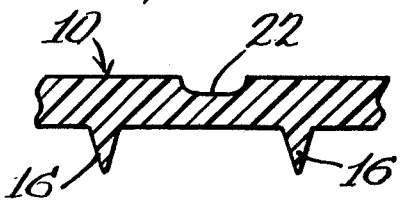

CARPET RUNNER

BACKGROUND OF THE INVENTION

This invention relates to carpet runners and, more specifically, to carpet runners in webbed form stored as rolls or the like.

Many modern-day retailers, such as so-called "discount" retailers, minimize the number of sales personnel in a retailing operation to minimize overhead, thereby enabling the sale of goods at lower prices. While such operations are a benefit to the consumer in terms of lower prices, frequently, the purchaser may have difficulty in that a clerk is not available for assistance.

Carpet runners are frequently formed of elongated webs of plastic having a thickness on the order of 0.04 inches or greater and are coiled in rolls of great length. Far more often than not, the length of such a roll will be greatly in excess of the length requirements of a particular customer. Thus, it is necessary that a length of the web be separated from the remainder in order to just satisfy the needs of a particular purchaser.

Where the clerk assistance is available, such web separation to desired lengths poses no problem since the clerk will normally be provided with a suitable cutting tool whereby the separation may be easily accomplished. However, in those operations where the number of sales personnel is minimized, the lack of assistance may pose an impediment to sales. Moreover, it is not always practical to provide a cutting tool for use by the customer since the customer may tend to misplace the tool after use. Occasionally, the tools will be stolen.

SUMMARY OF THE INVENTION

It is the principal object of the invention to provide a new and improved carpet runner. More specifically, it is an object of the invention to provide a carpet runner that may be easily separated to a desired length by a customer without the need of sales personnel assistance.

An exemplary embodiment of the invention achieves the foregoing object in a carpet runner defined by an elongated web of flexible, liquid-impervious, plastic material. One side of the web is provided with a plurality of projections for gripping the nap of an underlying carpet. In order to facilitate easy separation by the customer, the web is provided with a plurality of substantially equally spaced, transverse lines of weakening at predetermined intervals. As a consequence, a customer may determine the desired length of runner for his particular needs and tear the web along the adjacent line of weakening without the need of cutting tools or the like.

In a preferred embodiment of the invention, the lines of weakening are liquid-impervious to thereby maximize the protection for the carpet provided by the runner.

In a highly preferred embodiment of the invention, the lines of weakening are defined by grooves extending only partially through the web. The grooves may be provided with spaced strengthening ribs to minimize accidental tearing.

In a highly preferred embodiment, at least one end of each groove adjacent an edge of the web includes a short slit extending fully through the web to allow easy initiation of the separation of the predetermined length of runner from the remainder of the web while essentially maintaining the liquid-impervious characteristic of the runner.

Other objects and advantages will become apparent from the following specification taken in connection with the accompanying drawings.

DESCRIPTION OF THE DRAWINGS

FIG. 1 is a perspective view of a coiled web of a carpet runner made according to the invention;

FIG. 2 is an enlarged, fragmentary plan view of a carpet runner;

FIG. 3 is a vertical section taken approximately along the line 3—3 of FIG. 2; and FIG. 4 is an enlarged, fragmentary vertical section taken approximately along the line 4—4 of FIG. 2.

DESCRIPTION OF THE PREFERRED EMBODIMENT

An exemplary embodiment of a carpet runner made according to the invention is illustrated in FIG. 1 and is seen to include an elongated web, generally designated 10, of flexible plastic rolled into a coil 12 for space conservation purposes. Typically, the web 10 will have a width on the order of two feet or more and a length of 50 feet or more and, possibly, on the order of several hundred feet.

The web 10 may have decorative embossing on one side thereof, while on the other side thereof, there will be provided a plurality of downwardly extending projections 16, which serve as carpet grippers by penetrating into the underlying carpet with which the carpet runner is used. Typically, the thickness of the web 10 will be on the order of 0.040 inches, with the result that the same will have substantial resistance to tearing.

Spaced along the web 10 at predetermined intervals are transverse or cross lines of weakening 18. The transverse lines of weakening 18 will typically be equally spaced from each other at intervals on the order of approximately one foot for convenience although such spacing may differ, dependent upon any decorative pattern embossed on the web.

Since a principal function of a carpet runner is to protect an underlying carpet from accelerated wear and soiling, it is highly desirable that the cross lines of weakening 18 be liquid impervious. To this end, and as seen in FIGS. 2, 3 and 4, the cross lines of weakening 18 are defined by grooves 20. Preferably, the grooves 20 will extend only partially through the web 10 to provide a liquid impervious character. To facilitate easy separation of the web into segments along the cross lines of weakening, it is also desirable that the grooves 20 have a depth equal to at least half the thickness of the web.

As seen in FIGS. 2 and 4, periodically along the length of each groove 20, there may be provided strengthening ribs 22 for the purpose of minimizing the susceptibility of the web 10 to accidental tearing along one of the lines of weakening 18. According to one embodiment of the invention, the ribs 22 may have a length of approximately $\frac{1}{4}$ inch and be separated from each other by approximately $\frac{1}{2}$ inch, substantially as illustrated in FIG. 2. Preferably, although not necessarily, the surface of each rib 22 remote from the bottom of the groove 20 does not extend fully to the surface of the web 10.

In addition, in order to render the web 10 suceptible to easy initiation of a separation operation along each groove 20, at least one end of each groove 20 is provided with a relatively short slit 24 which extends fully through the web 10. Typically, the length of the slit 24 will be on the order of $\frac{5}{8}$ inch which is sufficient to enable the customer to grasp those portions of the web 10 on either side of the slit 24 and easily initiate tearing. Such a length is insufficient, however, to render the web 10 liquid pervious at the lines of weakening.

A carpet runner made according to the invention may be marketed without sales personnel assistance by disposing a roll, such as the roll 12, on a spindle. A customer may unroll the roll from its loose end to provide a runner of a desired length and simply separate the runner from the remainder of the web along one of the lines of weakening 18 nearest the desired length by tearing.

A carpet runner made according to the invention can be manufactured according to the method of the commonly assigned Hlinka U.S. Pat. No. 3,551,544, utilizing the materials (such as vinyl or other plastics) identified therein simply by the provision on either the first or the second pressure rollers therein disclosed of radially outwardly extending ribs located parallel to the axis of the roller and spaced around the periphery thereof at the desired interval. If it is desired to form the grooves in the underside of the runner, then such ribs will be located on the first pressure drum. On the other hand, if the grooves are to be located on the upper surface of the runner, such ribs will be placed on the second of the pressure rollers. Naturally, the ribs will be configured so as to not completely cross the gap between the two pressure rollers.

From the foregoing, it will be appreciated that a carpet runner made according to the invention retains the advantages of carpet runners heretofore known in precluding accelerated wear of carpeting as well as the soilage thereof, while rendering marketing of the same significantly more easy. Because of the liquid impervious nature of the lines of weakening, all of the foregoing objects are retained.

We claim:

1. In a carpet runner including an elongated web of flexible, liquid-impervious, plastic material having on one side thereof a plurality of projections for gripping the nap of an underlying carpet, the improvement wherein said web is provided with a plurality of substantially equally spaced, transverse lines of weakening whereby a desired predetermined length of said web may be easily separated from the remainder thereof along a desired one of said lines to provide a carpet runner of a desired length without the use of cutting tools or the like, said lines of weakening being liquid-impervious, said lines of weakening being defined by grooves extending only partially through said web, said grooves including spaced strengthening ribs.

2. In a carpet runner including an elongated web of flexible, liquid-impervious, plastic material having on one side thereof a plurality of projections for gripping the nap of an underlying carpet, the improvement wherein said web is provided with a plurality of substantially equally spaced, transverse lines of weakening whereby a desired predetermined length of said web may be easily separated from the remainder thereof along a desired one of said lines to provide a carpet runner of a desired length without the use of cutting tools or the like, said lines of weakening being liquid-impervious, said lines of weakening being defined by grooves including spaced strengthening ribs and extending only partially through said web, at least one end of each groove adjacent an edge of said web including a short slit extending fully through the web to allow easy initiation of the separation of the web while essentially maintaining a liquid-impervious character.

* * * * *